US007028629B2

(12) United States Patent
Walcome

(10) Patent No.: US 7,028,629 B2
(45) Date of Patent: Apr. 18, 2006

(54) SELF-SEALING PORT LIGHT ASSEMBLY

(76) Inventor: Richard Walcome, 240 Airport Rd., Port Townsend, WA (US) 98368

( * ) Notice: Subject to any disclaimer, the term of this patent is extended or adjusted under 35 U.S.C. 154(b) by 56 days.

(21) Appl. No.: 10/769,105

(22) Filed: Jan. 30, 2004

(65) Prior Publication Data

US 2004/0184275 A1 Sep. 23, 2004

Related U.S. Application Data

(60) Provisional application No. 60/444,984, filed on Feb. 3, 2003.

(51) Int. Cl.
*B63B 19/00* (2006.01)

(52) U.S. Cl. ..... 114/173

(58) Field of Classification Search ..... 114/173, 114/176–177, 178

See application file for complete search history.

(56) References Cited

U.S. PATENT DOCUMENTS

| | | | | |
|---|---|---|---|---|
| 3,967,424 A | | 7/1976 | Gates | 52/208 |
| 4,095,640 A | | 6/1978 | Beckerer, Jr. | 160/92 |
| 4,363,349 A | | 12/1982 | Childs | 160/90 |
| 4,363,350 A | | 12/1982 | Beckerer | 160/92 |
| 4,376,418 A | | 3/1983 | Childs | 114/178 |
| 4,572,266 A | | 2/1986 | Beckerer, Jr. et al. | 160/92 |
| 4,648,435 A | | 3/1987 | Beckerer, Jr. et al. | 160/92 |
| 4,729,584 A | | 3/1988 | Beckerer, Jr. | 292/257 |
| 4,976,212 A | | 12/1990 | Camarota | 114/178 |
| 5,284,105 A | * | 2/1994 | Wilkins | 114/173 |
| 5,758,593 A | | 6/1998 | Kyle | 114/178 |
| 5,842,433 A | * | 12/1998 | Kyle | 114/173 |
| RE36,436 E | | 12/1999 | Kyle | 114/178 |

* cited by examiner

*Primary Examiner*—Sandra O'Shea
*Assistant Examiner*—Robert J. May

(57) ABSTRACT

A port light assembly for watercraft having an exterior frame comprising a finish ring and a spigot defining a port light opening. The spigot is inserted in a hole in a vessel hull from the exterior of the vessel. The spigot is configured to provide drains to keep water from pooling near the port light. The exterior frame is connected to an interior frame that is placed around the spigot from the inside of the vessel. An innermost frame, retaining a glass lens, is hingedly connected to the interior frame. The assembly includes a screen installable from inside the hull. The frames are constructed from plastic and reinforced by strips of non-corrosive metal. The assembly is adjustable for hull thickness. The assembly is installed without the use of caulk or adhesives, it provides a water-tight seal between the exterior and interior of the vessel.

23 Claims, 5 Drawing Sheets

FIG. 9
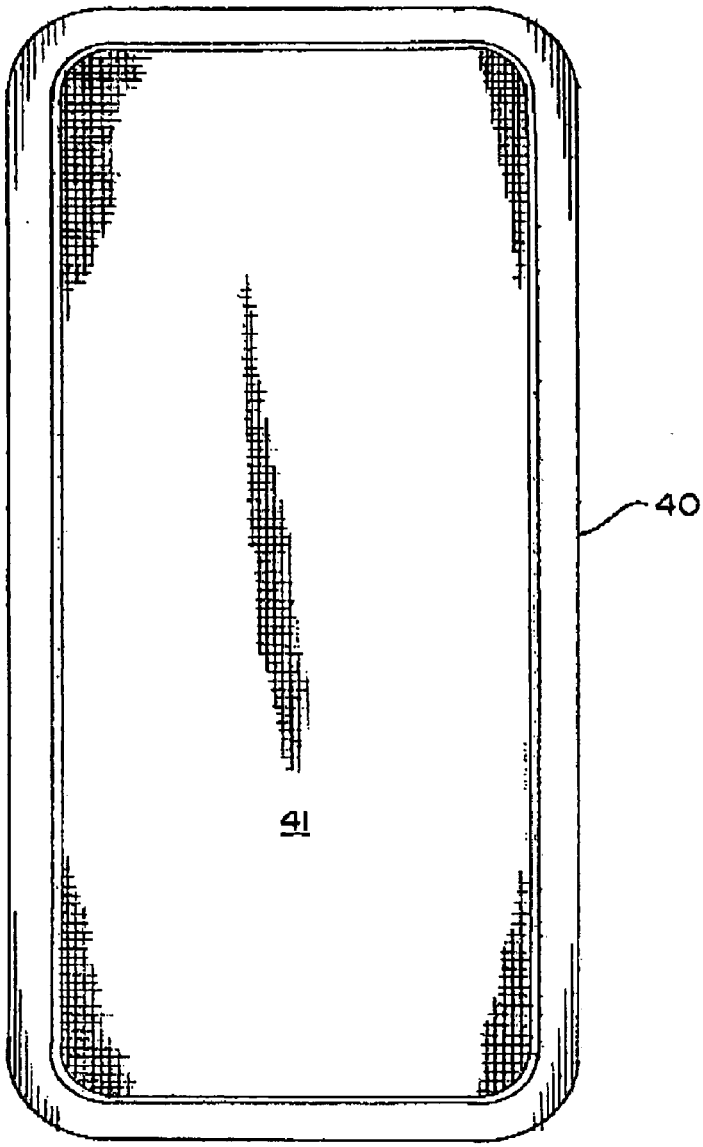
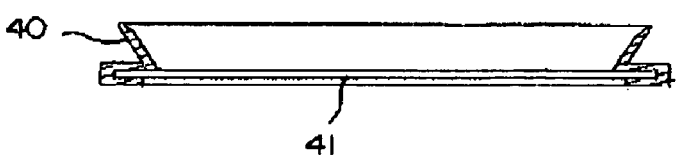
FIG. 10

SELF-SEALING PORT LIGHT ASSEMBLY

CROSS REFERENCE TO RELATED APPLICATION

This application claims priority from U.S. Provisional Patent Application No. 60/444,984, filed Feb. 3, 2003, entitled "Self-Sealing Port Window Assembly."

FIELD OF INVENTION

The present invention relates to port lights for use in boats. More particularly, the present invention relates to a self-sealing port light constructed from plastic and non-corrosive metal.

BACKGROUND OF THE INVENTION

The term "port light" is used throughout this document to mean a port window for a marine vessel. While the subject of this disclosure and the prior art are described using the term "port light", the terms "port window" and "window" could be used to describe port light disclosed herein.

A variety of types of port lights, both openable and non-openable, have been available for installation on cabin and hull walls of boats for many years to provide natural light and, in the case of openable port lights, ventilation.

Traditionally, such port lights were fabricated of glass mounted in metal frames. These frames were generally constructed from brass, stainless steel, or other corrosion resistant metal. While the metal frames are extremely durable, the frame materials are quite expensive and frames constructed entirely of these metals can be quite heavy, thereby adding significant weight to the watercraft.

In an effort to combat the expense and additional weight, frames constructed from aluminum have been used. Aluminum, however, is susceptible to corrosion; especially in salt atmospheres such as are encountered in marine applications. Corrosion of aluminum frames may be prevented by painting the frames, but this maintenance effort is not always pursued; also, paint does not adhere readily to aluminum. Therefore, where a diligent painting program is pursued the port light frames must be repainted frequently.

In an effort to overcome the disadvantages associated with aluminum frames, a frame is fabricated from plastic and resins were introduced. The lenses used in these frames are generally a transparent pane of plastic or resin material. An example of a port light material used for marine applications would be a pane of Plexiglas™ having a shape that corresponds with the frame. These frames have the advantage that they are made entirely of synthetic materials which are resistant to corrosion and which can be colored to harmonize with the remaining structure in which they are installed. The frames are either bonded or screwed to the basic boat structure peripherally of the opening. Where provided, an interior trim frame is bonded or screwed to the interior of the boat structure for the purpose of ornamentation.

These frames are generally secured to a boat placing them through a hole in the hull and using some type of adhesive to bond the frame to the hull. Generally, the thickness of the frame material is relatively thin. Accordingly, the frames flex readily and the adhesive bond between the pane and the frame may break in response to such flexing. Where screws are used, the area of the frame around the screw hole is subject to additional stress when the frame and hull are flexing. This stress can cause the frames to crack around the screw locations. Additionally, the perimeter of the frame and the areas around screws are susceptible to leaking, especially when the adhesive fails or the frame cracks.

When port lights made from either plastic or aluminum are constructed so that the port could be opened for ventilation and then latched closed to secure the port in rough water, another major problem can occur. If the hinges and the mechanisms for securing the port in a closed position are made from plastic, they can become worn over time and fail. Plastic hinges and latching mechanisms also tend to crack due to stress on the port light that is caused by twisting in the hull. This is especially likely to happen right at the point where the hinge is attached to a frame containing a lens or pane of glass. When the plastic is cracked it is subject to catastrophic failure, which can cause a serious emergency when a vessel is out on a large body of rough water.

Cast aluminum hinges are subject to cracking in the same locations as plastic. Where steel pins are used in aluminum hinges, the hinges are more likely to corrode. If the corrosion is left unchecked, the hinge could fail when the boat is twisting due to rough water.

Other methods of installing port lights have also been tried with varying degrees of success. One method is to directly bolt plastic sheets to the side of a cabin to form a port light. Direct bolting has disadvantages, in that the manual labor required for bolting is costly, and the rough edge of the hole in the side of the cabin is unsightly. Another method is to cement plastic panes to the outside of the hull, thereby reducing the installation costs. However, there still remains the problem of the unsightly edge of the port hole in the side of the cabin and the problem associated with the adhesive bond failing due to the boat flexing. Additionally neither of these methods addresses the leaking problems discussed above.

Some companies have molded frames directly into the cabin side and have cemented the plastic panes into these frames. However, this involves complex molds and the difficult operation of removing the cabin sides from the molds. Also the edges of the panes have to be beveled, thereby increasing the expense of the port light.

In addition to the problems discussed above, there is a potential for water to leak into the interior of a boat cabin, in the area of the frame, around the periphery of the port light. This is especially the case near the bottom of the frame where water has a tendency to collect when a boat is rocking from side to side. To combat this potential for leaking, various drain configurations are used. Most of these drain configurations involve some type of grooves or channels running at a right angle to the face of the port light on the frame.

Most commercially available port lights are constructed so that the main portion of the fame is installed from the inside of the hull. Some of these frames include an outside finish ring but it is not uncommon that such a finish ring is not included. Because these frames are installed from the inside, the water that runs out of the drains can still leak into the hull around the perimeter of the fame. Additionally, the drains on most frames do not run all the way to the face of the port light and thereby leave an area where water can still collect when the boat is rocking.

SUMMARY OF THE INVENTION

Accordingly, it is an object of the current invention to provide a port window having a relatively durable frame.

It is also an object of the current invention to provide such a frame that is significantly lighter than frames constructed entirely from metal.

It is a further object of this invention to provide frames that are not susceptible to corrosion.

Another object of this invention is to provide such assemblies that are relatively easy to install and do not require the use of adhesives and/or screws.

It is also an object of this invention to provide such assemblies that are configured to allow water to drain from the frames.

These and such other objects of the invention, as will become evident from the disclosure below, are met by the port light assembly disclosed herein. The port light assembly of the current invention is comprised of an exterior frame formed from a single piece of plastic and reinforced with thin strips of non-corrosive metal. The exterior frame has a spigot and a flange like finish ring. The spigot is extended into a hole in the hull of a vessel from the exterior of the vessel, and the exterior frame is connected to an interior frame that is also formed from a single piece of plastic and reinforced with thin strips of non-corrosive metal.

A flexible, non-porous gasket on the finish ring creates a watertight seal, and the connectors used to connect the exterior frame and the interior frame have O-rings for creating a watertight seal at each connector.

The spigot has a pair of grooved drains with a continuous downward angle allow water to drain even when the port light is tilted inward. This configuration does not allow water to pool against the lens of the port light and leak in around the lens.

The lens is secured in an innermost frame by a flexible, non-porous gasket. When the innermost frame is installed, the gasket forms a watertight seal with a lip on the spigot. The innermost frame is connected to the interior frame by a pair of adjustable hinges and can be secured in a closed position by a pair of adjustable latches.

The hinges and latches include threaded posts that are engaged with shouldered adjustment nuts secured in the interior frame. The hinges and latches can be adjusted for hull thickness so that the assembly can be used on a variety of vessels. Once the assembly is installed, the latches and hinges can be adjusted so that the gasket on the innermost frame forms a watertight seal with the spigot lip.

A screen can be installed from the inside of the vessel hull, and the screen can remain on the assembly without any effect on the watertight seal. A spacer frame can be used for vessels with relatively thin hulls to ensure that a proper watertight seal is achieved.

The port light assembly of the current invention overcomes the disadvantages of the prior art by providing a lightweight plastic assembly that is reinforced at all stress points with thin strips of non-corrosive metal. This combination of plastic and metal saves money on production and lowers overall boat weight while providing a durable port window assembly. Additionally, if the assembly ever needs to be replaced, the non-corrosive metal can be removed from the plastic portion of the frame and re-used, again providing a significant savings.

The port window assembly of the current invention is adjustable for hull thickness and can be easily installed on a variety of boats. The assembly can be installed without the use of caulk or adhesive, thereby saving on installation and cleanup costs. The assembly provides a watertight seal and allows water to drain away from the window even when it is tilted inboard.

BRIEF DESCRIPTION OF THE DRAWINGS

The several objectives and features of the present invention will become more readily apparent from the following detailed description taken in conjunction with the accompanying drawings in which:

FIG. 9 shows a screen for use on the port light described herein.

FIG. 10 is cross section showing the shape of the frame for the screen used on the port light described herein.

BEST MODE OF CARRYING OUT THE INVENTION

Figure 1:
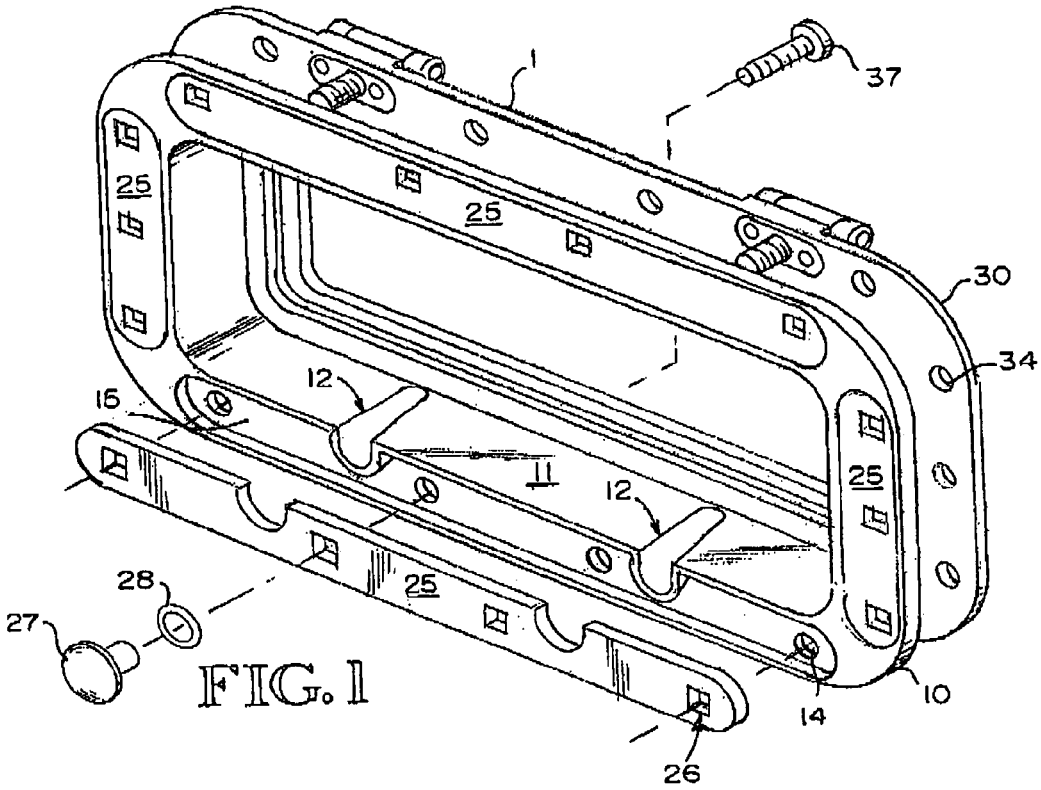
FIG. 1 is an elevated perspective view showing the exterior frame of the port light assembly described herein

Turning now to the drawings, the invention will be described in preferred embodiments by reference to the numerals of the drawing figures wherein like numbers indicate like parts.

Figure 2:
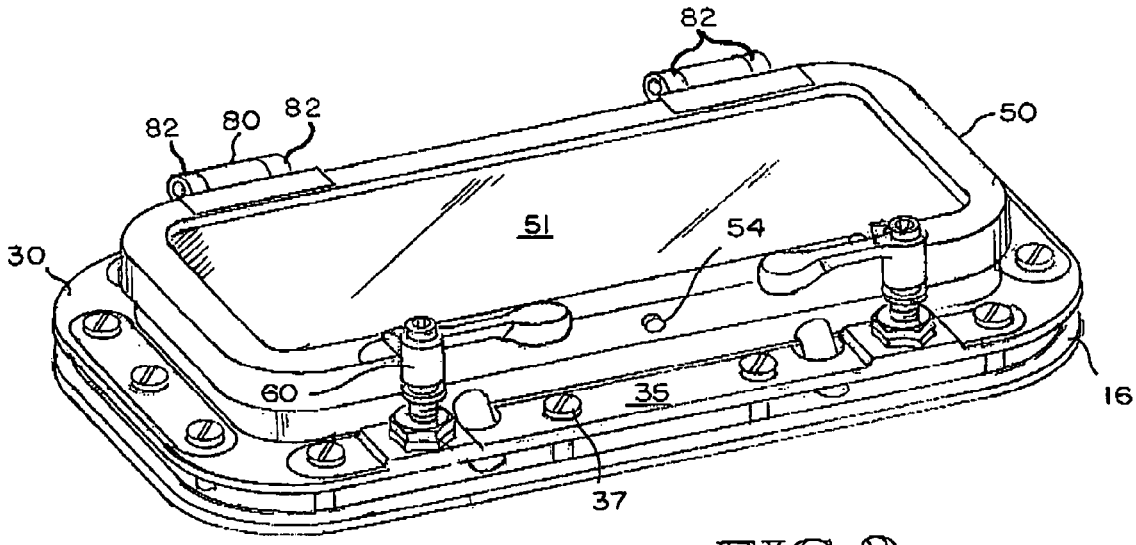
FIG. 2 is an elevated perspective view showing the interior frame of the port light assembly described herein.
Figure 3:
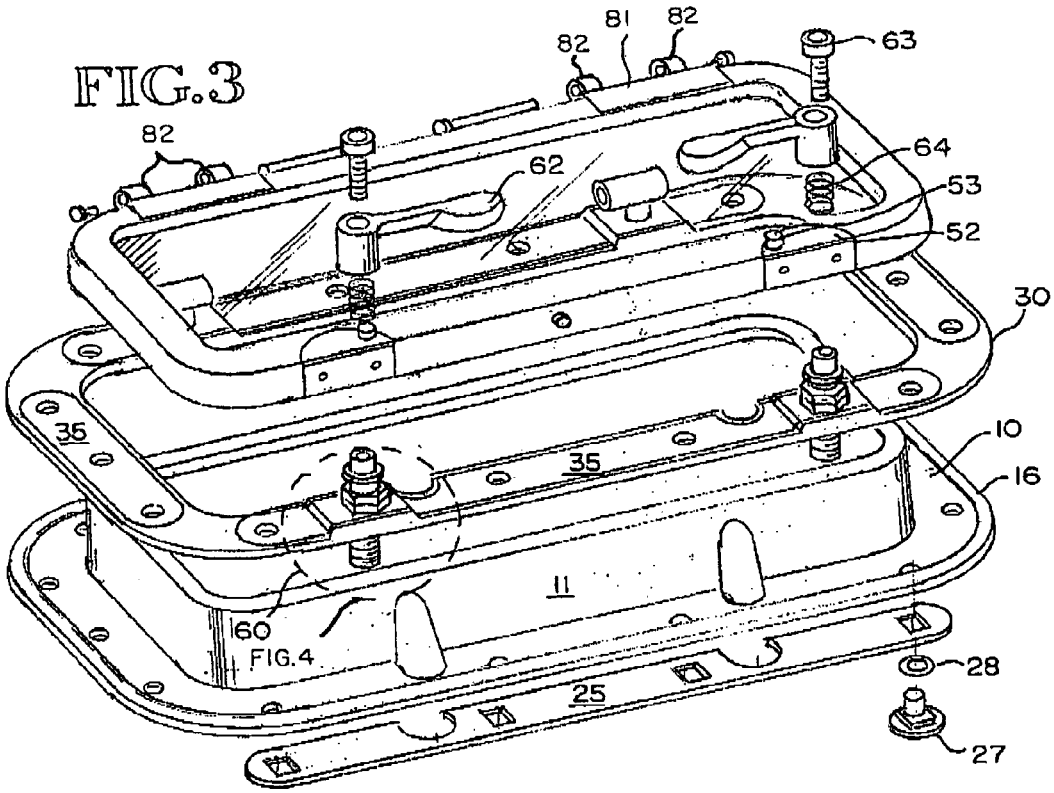
FIG. 3 is an elevated perspective view showing the various components of the port light assembly described herein.

FIG. 1 through FIG. 3 show a preferred embodiment of the port light 1 disclosed herein. The port light has a one-piece exterior frame that forms a spigot 11 and a finish ring 10. The spigot 11 is configured for insertion into a hole in the hull of a vessel from the exterior of the vessel hull. The spigot 11 of the embodiment depicted has a pair of grooves on the lower interior surface that function to drain water out of the spigot and away from the port light.

The finish ring 10 extends at a right angle from the end of the spigot that is not inserted into the vessel hull. The exterior frame is constructed from plastic, and the exterior surface of the finish ring 10 has a plurality of recessed areas 15 for insertion thin strips of metal 25 for reinforcing the frame. In the embodiment depicted, the metal strips 25 are made from stainless steel, but other types of non-corrosive metal are suitable for such use as well.

When the spigot 11 is inserted into a hole in a vessel hull the interior surface of the finish ring 10 rests against the vessel hull. When the port light assembly 1 is attached to the vessel hull, a flexible gasket 16 creates a watertight seal between the finish ring and the exterior of the vessel hull. In the preferred embodiment depicted, the gasket 16 is made from high-density silicon closed cell foam and it is affixed to a groove located on the interior surface of the finish ring 10. When the exterior frame is connected to the interior frame 30 the gasket is compressed to create a seal between the finish ring and the vessel hull.

The interior frame 30 of the port light is also made from plastic and it is configured for placement around the spigot 11 from the interior of a vessel hull. The interior frame has a plurality of recessed areas (not shown), on the surface of the frame that would face into the cabin, for placement of thin metal reinforcing strips.

The finish ring 10 and the interior frame 30 both have a plurality of fastener holes 14 & 34 spaced around the perimeter of the frames. The metal reinforcing strips 25 for the finish ring 10 have a plurality of holes 26 that correspond to the holes 14 in the finish ring 10. The holes 26 are in the finish ring strips 25 are configured for insertion of a carriage head bolt 27. The carriage head bolts 27 have a threaded interior cavity.

The metal reinforcing strips 35 for the interior frame 30 have a plurality of fastener holes 36 that correspond to the holes 34 in the frame. The holes 36 in the interior frame strips 35 are configured for insertion of a truss head screw 37. The truss head screws 27 are threaded for engagement with the threaded interior cavity of the carriage head bolts 27.

The innermost frame 50 is also made from plastic and it is hingedly connected to the interior frame 30 by a pair of adjustable hinges 80 on the top edge of the innermost frame 50. The innermost frame has a lens 51 retained therein. The lens 51 is held into the innermost frame by a flexible gasket.

When the preferred embodiment depicted in the figures is connected to a vessel hull, the innermost frame can be rotated between an up and open position or a down and closed position. The frame post 54 on the innermost frame can be used with a cord connected to the bulkhead on the vessel interior for securing the frame in an open position. When the innermost frame is in the closed position it is held in place by a pair of adjustable latches 60 that are threadedly connected to the interior frame 30.

The frame 50 is reinforced along the top edge by hinge plates 81 that are threadedly connected to the innermost frame, and at the bottom edge by a pair of latch striker plates 52 that are also threadedly connected to the innermost frame. In the embodiment depicted, the hinge plates 81, the striker plates 52, the components of the hinges 80, and the components of the latches 60 are all constructed from stainless steel. However, other types of non-corrosive metals are suitable for use and such metals are used in other embodiments of the port light disclosed herein.

The port light disclosed herein is designed to be inserted into a hole in a vessel hull that is bigger than the outer perimeter of the spigot 11. The hole much be big enough that the hull will not obstruct the carriage head bolts 27 inserted through the finish ring 10 and its metal reinforcing strips 25 or the truss head screws 37 inserted through the holes in the interior frame 30 and its reinforcing strips 35.

To install the port light, the spigot 11 is inserted into a hole in a vessel hull such that the gasket 16 on the finish ring 10 rests against the exterior of the hull and the drain grooves 12 directly over the bottom edge of the hole in the hull. The interior frame 30 is then placed over the spigot ring 11 from the interior of the vessel hull such that the hinges 80 are at top of the hole and the innermost frame 50 can be rotated upward for opening.

A flexible O-ring 28 is then placed over each carriage head bolt 27 and the bolts are inserted into the holes in the finish ring reinforcing strips 25 and the finish ring 10. The truss head screws are then placed in the holes in the interior frame reinforcing strips 35 and the interior frame 30, and threadedly engaged with the carriage head bolts 27. The truss head screws are tightened causing the gasket 16 to compress and form a watertight seal between the finish ring 10 and the vessel hull. The O-rings 28 are constructed from silicon or other non-porous material, and they form a watertight seal around the carriage head bolts thereby preventing leaks around the fasteners. After the hinges 80 and the latches 60 have been adjusted for hull thickness and the latches have been adjusted for tension, the innermost frame 50 can be locked in a closed position to form a watertight seal between the innermost frame 50 and the spigot 11.

This method of installation requires no adhesives for securing the assembly to the vessel hull, nor does it require any caulk to create a watertight seal between the hull and the assembly. Installing the assembly disclosed herein requires significantly less time than what is needed for conventional port lights and there is no clean up of messy caulk or adhesives.

The assembly maintains a watertight seal when the hull undergoes torque or twisting due to rough water. The seal is not susceptible to degradation due to sunlight or contact with salt water. Should the assembly be damaged, it can be easily removed and replaced without having to remove old caulk or adhesive as is required when replacing conventional port lights.

Figure 4:
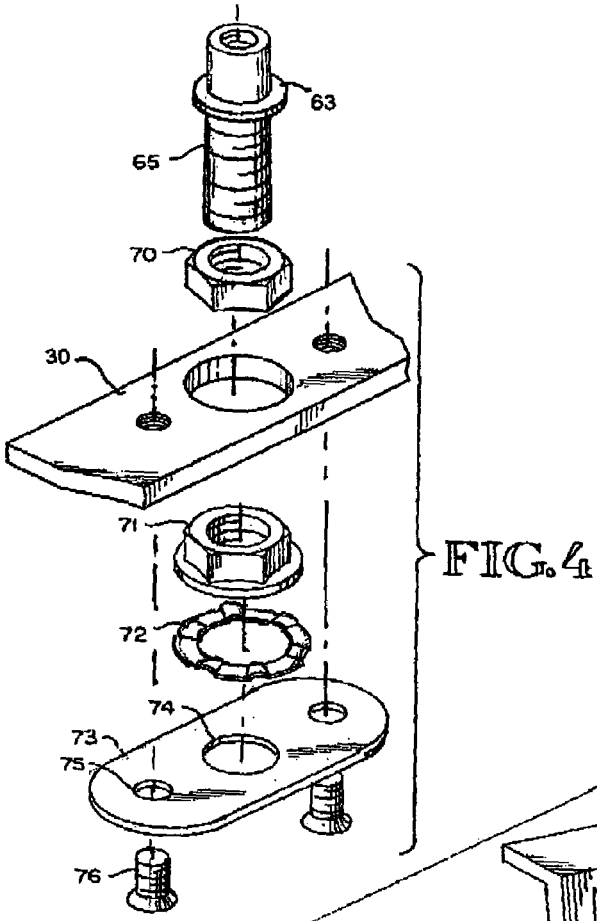
FIG. 4 shows the components of the latches of the port light assembly described herein.

FIG. 3 and FIG. 4 show the latches used on a preferred embodiment in more detail. The latches 60 in the embodiment depicted are constructed from stainless steel, but other types of non-corrosive metals can be used in other embodiments of the port lights. The latches 60 are hollow tubes that have a latch lever 62 and a latch dog (61 FIG. 5) extending from the exterior surface of the tube at right angles from each other. The tube is configured for placement over the latch adjustment post 65. One end of each tube has a raised lip 63 to provide for retention of the latch tension spring 64 when the latch is placed on the adjustment post.

The upper half of the latch adjustment posts 65 have a smooth surface so that the latches can rotate around the adjustment posts, and the lower half of the adjustment posts are threaded for engagement with a latch locking nut 70 and a shouldered latch adjustment nut 71. The upper half of the latch adjustment posts 65 have a threaded interior cavity for engagement with the cap headed latch retention screws 63 that are inserted through the top of the latches.

The surface of the interior frame 30 that faces the hull of the vessel has a pair of recessed areas (not shown) on the bottom edge thereof. A latch adjustment hole communicates into each recessed area from the surface of the frame that faces the interior of the vessel, through the metal reinforcing strips 35 and the frame 30. The latch adjustment holes are sized in a manner that allows the latch adjustment nut to be inserted through the holes from the recessed areas. The recessed areas are configured so that a latch adjustment nut 71 can be inserted into a recessed area such that the nut extends through a latch adjustment hole and rotate freely, but the nut is retained in the recessed area by the shoulder.

Once the latch adjustment nuts 71 are inserted into the latch adjustment holes from the recessed area, a spring washer 72 is placed next to each nut. Retention plates 73, each having a pair of fastener holes 75 and a latch adjustment hole 74 are then connected to the interior frame by engaging the threaded fasteners 76 with threaded holes that communicate into the interior frame. The latch adjustment nuts 71 are thereby retained in the recessed area of the frame, while still being able to rotate freely.

When the port light assembly is first installed onto a vessel, each latch adjustment post 65 is threadedly engaged with a latch adjustment nut 71 and a latch-locking nut 70. Each latch-locking nut 70 is rotated up the adjustment post toward the center such that it does not make contact with the latch adjustment nut 71. The tension springs 64 are inside the tubular portion of the latches and the latches are placed on the adjustment posts such that the latch dogs 61 are in contact with the latch stop lugs 53 on the latch striker plates 52. The latch retention screws 63 are loosely engaged with the threaded interior cavity of the latch adjustment posts 65.

After the hinges have been adjusted for the thickness of the hull (described below) the latches are adjusted by rotating the adjustment nuts and causing the latch posts to move in a desired direction until the latches holds the innermost frame 50 snugly, but not tightly, against the spigot 11. The latch locking nuts 70 are then rotated until they are tight against the latch adjustment nuts 71, and the latch retention screws are then tightened until the latches hold the innermost frame tightly against the spigot.

Figure 5:
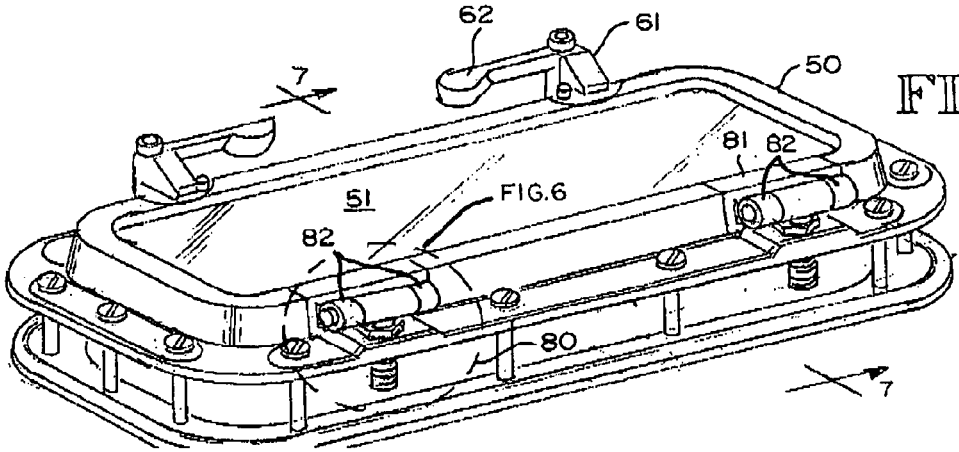
FIG. 5 is an elevated perspective view showing the location of the hinges on the port light assembly described herein.

As can be seen in FIG. 2, FIG. 3, and FIG. 5, in a preferred embodiment the latches are installed so that the latch levers 62 are oriented toward each other and the frame post 54. The latch dogs 61 rest against the latch stop lugs 53 thereby preventing further downward rotation of the latch levers such that the innermost frame will become unsecured due to the force of gravity on the latches when the vessel is moving. The latches are unlocked for opening the innermost frame by rotating the latch levers upward, thereby allowing the innermost frame to be opened. When the innermost frame is in a closed position, it can be secured by rotating the latches in the reverse of the rotation for opening the frame. The edges of the striker plate 52 have a slight bevel to allow the latch dogs to ride up on the striker plate and cause compression of the gasket 56 between the innermost frame and the spigot.

It should be noted that the latch adjustment posts can move inwardly or outwardly relative to the vessel interior. A convenient method for adjusting the posts is to start with the posts extended inwardly as far as possible such that they are still engaged with adjustment nut and then adjust the latches as desired by rotating the adjustment nut so that the post moves outwardly. While the adjustable latches are suitable for a variety of hull widths, it has been found drilling a hole into the interior of a thick hull, such that the adjustment post can fit into the hull, makes such adjusting the latch easier for vessels with thick hulls.

Figure 6:
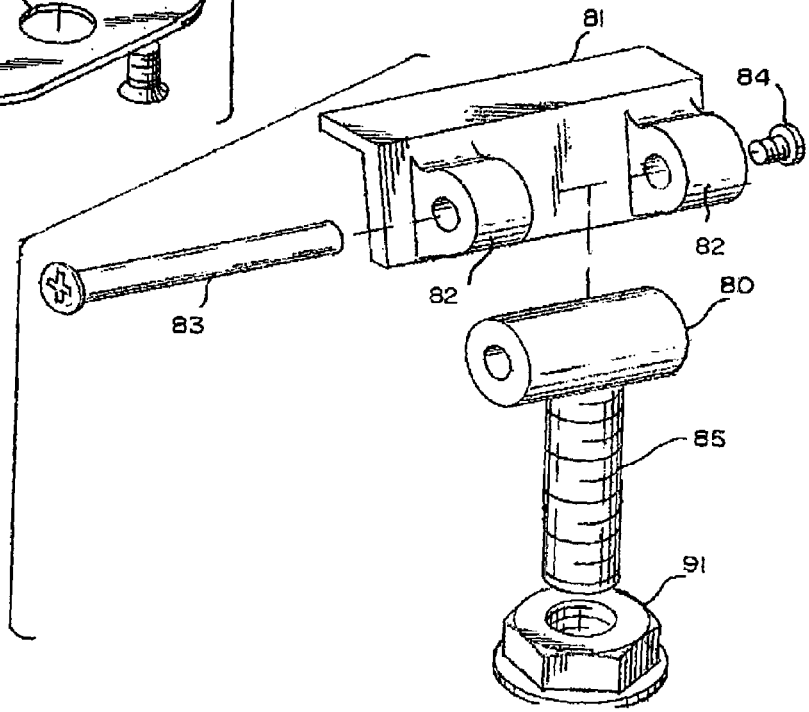
FIG. 6 shows the components of the hinges of the port light assembly described herein.

FIG. 5 and FIG. 6 show the hinges used on a preferred embodiment in more detail. Each of the hinges 80 is a hollow tube that has a hinge adjustment post extending at a right angle from the exterior of the hinge. A pair of hinge plates 81, each having a pair of hinge ears 82 extending from the surface of the plate, are threadedly connected to the top edge of the innermost frame. Each hinge is attached to the innermost frame 50 by inserting a hinge pin 83 through one hinge ear 82, through the hinge, and into the other hinge ear 82. Each hinge pin 83 has a threaded interior cavity that is configured for engagement with a hinge pin screw 84. Once the hinges are connected to the innermost frame, the hinge pin screws 84 are screwed into the interior cavity or the hinge pins 83 to secure the hinge to the innermost frame 50.

The surface of the interior frame 30 that faces the hull of the vessel has a pair of recessed areas (not shown) on the top edge thereof that are similar to those used for threadedly connecting the latches to the interior frame as described above. A hinge adjustment hole communicates into each recessed area from the surface of the frame that faces the interior of the vessel, through the metal reinforcing strips 35 and the frame 30. The hinge adjustment holes are sized in a manner that allows a shouldered hinge adjustment nut 91 to be inserted through the holes from the recessed areas. The recessed areas are configured so that a hinge adjustment nut 91 can be inserted into a recessed area such that the nut extends through a hinge adjustment hole and rotate freely, but the nut is retained in the recessed area by the shoulder.

The manner of placing and securing the hinge adjustment nuts in the interior frame is the same as that used for the latch adjustment nuts as described above. Once the hinge adjustment nuts 91 are inserted into the hinge adjustment holes from the recessed area, a spring washer not shown is placed next to each nut. Retention plates not shown, each having a pair of fastener holes and a hinge adjustment hole are then connected to the interior frame by engaging the threaded fasteners not shown with threaded holes that communicate into the interior frame. The hinge adjustment nuts 91 are thereby retained in the recessed area of the frame, while still being able to rotate freely.

Figure 7:
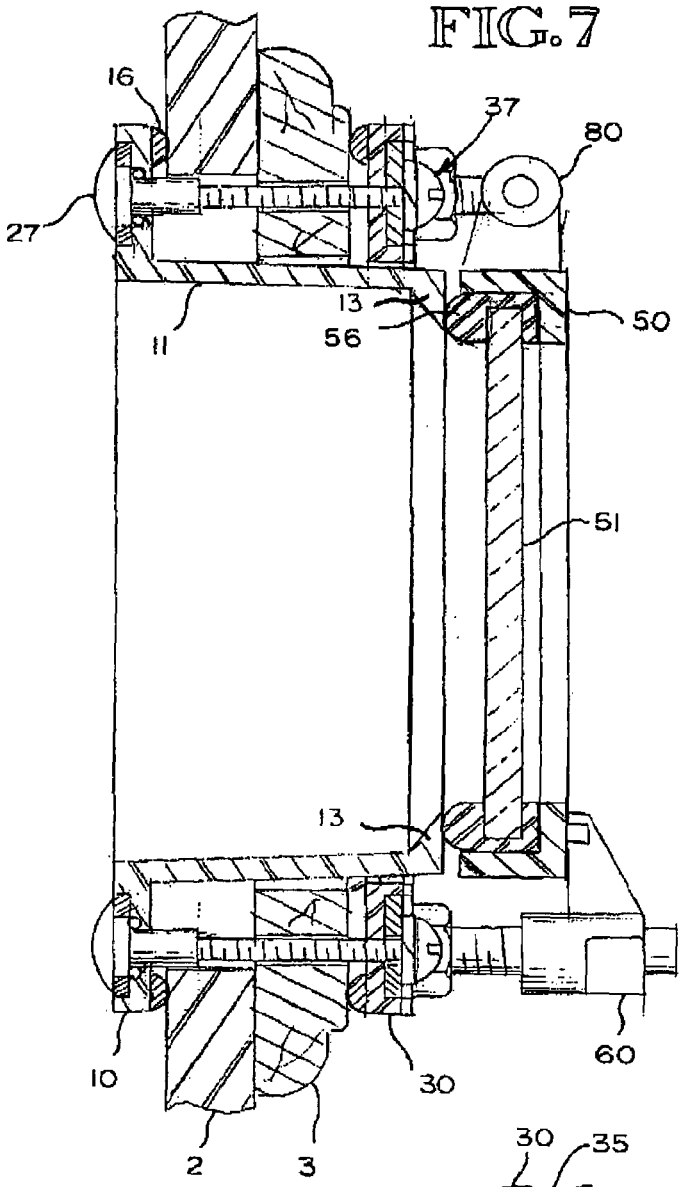
FIG. 7 is a cross section view of the pot light assembly described herein as it is installed on the hull of a boat.

When the port light assembly is first installed onto a vessel, each hinge adjustment post 85 is threadedly engaged with a hinge adjustment nut 91. Referring to FIG. 7, the hinges are adjusted for hull thickness by turning the hinge adjustment nuts 91 to move the hinge posts in the desired direction until the inner gasket 96 is tight against the top interior edge of the spigot 11. After the latches have been adjusted, as described above, minor adjustments can be made to the hinges to ensure that the seal between the innermost frame and the exterior frame is watertight.

It should be noted that the hinge adjustment posts can move inwardly or outwardly relative to the vessel interior. A convenient method for adjusting the posts is to start with the posts extended inwardly as far as possible such that they are still engaged with adjustment nut and then adjust the hinges as desired by rotating the adjustment nut so that the post moves outwardly. While the adjustable hinges are suitable for a variety of hull widths, it has been found drilling a hole into the interior of a thick hull, such that the adjustment post can fit into the hull, makes such adjusting the hinge easier for vessels with thick hulls. It should also be noted that the hinges, hinge plates, adjustment nuts and the parts used to secure the hinge to the interior frame are constructed of stainless steel for the embodiment depicted. However, other types of non-corrosive metals are also suitable for such use and such metals are used on other embodiments of the port light assembly.

The hinge plates 81 and the latch striker plates 52 also provide reinforcement to the critical stress areas of the innermost frame 50. As noted above, these are the areas that are subject to stress fractures in frames constructed from cast aluminum and frames constructed completely from plastic. Because the innermost frame is reinforced at these critical areas by the plates made from non-corrosive metal, and because the hinges and latches are made completely from the non-corrosive metal, there is a significantly lower chance for a catastrophic failure of the frame in rough water.

FIG. 7 shows a cross section of the port light disclosed herein as installed in a vessel hull. In the embodiment depicted, the spigot 11 has been inserted through a hole in the vessel hull 2. A spacer frame 3 can be used for hulls that are relatively thin so that a watertight seal can be achieved and to make the adjustment of the hinges 80 and latches 60 easier. The spacer frame 3 is configured for placement over the spigot 11, and the spacer frame has a plurality of fastener holes that correspond to the holes on the finish ring 10 and the interior frame 30. The spacer frame 3 also has a pair of hinge adjustment holes on its top edge and a pair of latch adjustment holes on the bottom edge that correspond to the hinge and latch adjustment holes in the interior frame 30.

It has been found that spacer frames are generally needed for vessels having a hull thickness of less that one-half inch thick. The frames can be used on hulls having a thickness greater than one-half inch as well, provided that a watertight seal can be achieved between the innermost frame 50 and the spigot 11. In the embodiment depicted, the spacer frame is constructed from Teak, but other types of wood and plastic are suitable for such use and are used on other embodiments of the port light.

The interior frame 30 is then placed over the spigot 11 such that it rests against the spacer frame 3. The carriage head bolts 27 with an O-ring around them are placed into the fastener holes in the finish ring 10 and finish ring reinforcement strips. The truss head screws 37 are placed into the fastener holes in the interior frame and interior frame reinforcing strips, and screwed tightly into the carriage head bolts 27. The gasket 16 on the interior surface of the finish ring 10 is compressed between the finish ring and the vessel hull 2, thereby creating a watertight seal between the finish ring and the vessel hull.

As can be seen in FIG. 7, the interior edge 13 of the spigot 11 extends slightly toward the center of the spigot to provide a sealing surface between the spigot and the innermost frame 50. The glass lens of the innermost frame is encased around its edges by a soft gasket 56 that is affixed to the innermost frame. In the embodiment depicted the gasket 56 is made from high-density silicon closed cell foam, but other flexible non-porous material can also be used in other embodiments.

After the finish ring 10 has been tightly connected to the interior frame 30, the hinges 80 and latches 60 are adjusted for hull thickness as described above and the latches are adjusted for tightness. Once adjusted, the hinges and the latches provide a uniform pressure on the innermost frame such that the inner gasket 56 creates a watertight seal between the innermost frame and the spigot. The spring washers that are adjacent to the adjuster nuts prevents the adjustment nuts from moving in the recessed areas due to rough water, or other twisting forces on the hull, and causing the frame to become loose such that the seal between the innermost frame and the spigot is broken.

If desired, the innermost frame can be opened by rotating the latch levers 180 degrees to disengage the latch dog from the latch striker plate and rotating the frame upward. When the innermost frame is in the open position, the latch tension springs keep the latch from rattling when the vessel shifts and moves.

FIG. 9 and FIG. 10 show a screen that can be installed on the port light disclosed here in. The screen 41 is held around its edges by a screen frame 40, and the screen 41 is affixed to the frame to ensure that it remains in the frame. The frame 40 depicted is constructed from the same flexible material as the gasket 16 on the finish ring and the inner gasket 56, but other non-porous materials having suitable flexibility material memory properties are suitable for such use. The screen frame has a cross sectional shape that is adapted for placement on the spigot 11 from the interior of the vessel hull after the port light assembly has been installed.

Figure 8:
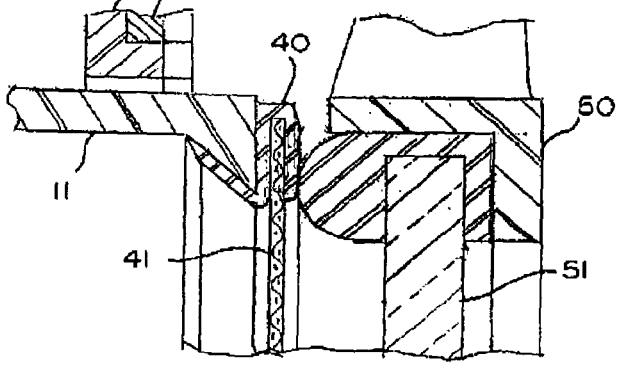
FIG. 8 is a cross section view showing the seal between the innermost frame and the exterior frame of the port light described herein.

FIG. 8 is a cross section view showing a port light assembly with a screen installed. The screen frame is placed over the raise lip 13 on the interior edge of the spigot 11 and remains in position due to the cross sectional shape of the frame and the memory properties of the closed cell foam. The hinges 80 and latches 60 can be adjusted such that the innermost frame can be closed and the screen frame 40 will form a watertight seal with the spigot 11 and the inner gasket 56.

Disclosed herein is a lightweight port light assembly that can be installed without the use of caulk and adhesives, thereby saving time installation costs, and cleanup costs. The use of plastic reinforced with non-corrosive metal at all stress points provides a relatively lightweight and inexpensive assembly with a high degree of durability. The metal portions of the port light are easily removable from the assembly so that they can be placed in a replacement assembly, thereby reducing replacement costs.

The port light assembly provides a watertight seal between the assembly and a vessel hull to prevent leaking, and provides a drain configuration that prevents water from pooling in the spigot when the port light is tilted inboard. The watertight seal will not fail when the vessel undergoes twisting and torque due to water conditions, nor will it fail if the vessel hull expands or contracts due to temperature changes. The assembly can be adjusted for the thickness of the hull, and the assembly can be opened to provide ventilation when conditions allow. A screen, that can be installed from the inside of the vessel hull, is disclosed for the assembly.

INDUSTRIAL APPLICABILITY

The invention has applicability to the field of boats and other watercraft having port lights. In particular, the present invention describes a self-sealing port light assembly. The assembly is easier to install that currently available port lights in that it does not require the use of caulks or adhesives to secure the assembly to the vessel in a watertight manner. Installation also does not require that additional fastener holes be placed through the hull.

The ease of installation will result in lower labor costs due to the decrease in time need for installation and the fact that workers need not be specially trained to install the assembly. Because the assembly is constructed from plastic and reinforced with metal, it decreases the overall weight of a vessel. The decrease in weight will result in less fuel being used, which in turn results in lower operating costs. The metal reinforcements cause the assembly to be durable, thereby resulting in fewer repairs and replacements.

In compliance with the statute, the invention has been described in language more or less specific as to structural features. It is to be understood, however, that the invention is not limited to the specific features shown or described, since the means and construction shown or described comprise preferred forms of putting the invention into effect. Additionally, while this invention is described in terms of being used for boats, it will be readily apparent to those skilled in the art that the invention can be adapted to other uses as well. Although not an exhaustive list of examples, other uses could include campers, trailers, and recreational vehicles. The invention is, therefore, claimed in any of its forms or modifications within the legitimate and valid scope of the appended claims, appropriately interpreted in accordance with the doctrine of equivalents.

What is claimed is:

1. A port light assembly comprising:

an exterior frame configured for insertion into a hole in a vessel hull;

an interior frame configured for placement over the exterior frame on the opposite side of the hull as the interior frame;

an innermost frame having a pane of glass retained therein;

means for connecting the innermost frame to the interior frame;

means for creating a watertight connection between the exterior frame and the interior frame without the use of adhesive materials and without the need to place additional holes in the vessel hull;

means for creating a watertight seal between the exterior frame and the exterior of the vessel hull without the use of caulk and without the use of adhesives; and means for creating a watertight seal between the innermost frame and the exterior frame.

2. The assembly of claim 1 wherein the exterior frame comprises a spigot having a first end, a second end, an inner surface, and an outer surface;

the exterior frame further comprising a finish ring having an interior surface and an exterior surface;

the spigot being configured for insertion into the hole in the vessel hull;

the finish ring extending at a right angle from the outer surface of the spigot in a flange-like manner at the second end of the spigot and being configured such that when the first end of the spigot is fully inserted into the vessel hull, the finish ring is parallel to and adjacent to the surface of the vessel hull; and the interior frame has a bulkhead surface, a cabin surface, and is configured for placement around the spigot such that the interior frame rests against a bulkhead on the interior of the vessel hull.

3. The assembly of claim 2 wherein the exterior frame, the interior frame, and the innermost frame are constructed from plastic; and the finish ring, the interior frame, and the innermost frame are reinforced by thin pieces of non-corrosive metal.

4. The assembly of claim 3 wherein the finish ring and the interior frame each have a plurality of corresponding holes communicating therethrough;

the thin pieces of metal used to reinforce the finish ring have a plurality of holes communicating therethrough that correspond to the holes communicating through the finish ring and are adapted for the placement of a carriage head bolt;

the thin pieces of metal that reinforce the interior frame have a plurality of holes communicating therethrough that correspond to the holes communicating through the interior frame;

the assembly further comprises a plurality of carriage head bolts having a threaded interior cavity, a plurality of flexible O-rings that are sized such that the carriage head bolts can be inserted into the O-rings, and a plurality of truss head fasteners that are threaded for connection to the carriage head bolts; and the means for creating a watertight connection between the exterior frame and the interior frame without the use of adhesive materials and without the need to place additional holes in the vessel hull is to place the spigot through the hole in the vessel hull such that the finish ring covers the edges of the hole but the holes communicating through the spigot ring and the reinforcing metal are not obstructed by the vessel hull, placing the interior frame around the spigot on the inside of the vessel hull such that the holes communicating through the interior frame and reinforcing metal are aligned with the holes communicating through the finish ring, placing a carriage head bolt that has been inserted into a O-ring through each hole in the finish ring and reinforcing metal on the exterior of the hull, placing a truss head fastener through each hole communicating through the interior frame and reinforcing metal on the interior of the hull, and threadedly engaging the truss headed fasteners with the carriage head bolts.

5. The assembly of claim 4 wherein the means for creating a watertight seal between the exterior frame and the exterior of the vessel hull without the use of caulk and without the use of adhesives is a flexible gasket connected to the interior surface of the finish ring such that it will be in contact with the exterior of the vessel hull and create a watertight seal between the vessel hull and the finish ring when the exterior frame and the interior frame are securely connected to each other.

6. The assembly of claim 2 wherein the first end of the spigot has a raised sealing portion extending from the inner surface thereof, the inner surface of the spigot further having a pair of grooves that begin at the sealing portion and extend to the second end of the spigot such that water is drained from the spigot via the grooves.

7. The assembly of claim 6 wherein the innermost frame has a top edge, a bottom edge, an outside surface, an inside surface, and is hingedly connected to the interior frame such that the innermost frame can be rotated between an open position and a closed position;

the pane of glass is secured around its edges by a flexible gasket ring that is affixed to the innermost frame such that when the innermost frame is in a closed position, the flexible gasket ring contacts the raised sealing portion on the first end of the spigot; and the means for creating a watertight seal between the innermost frame and the exterior frame is to tightly secure the innermost frame in a closed position such that the gasket ring is compressed between the sealing portion of the spigot and the innermost frame.

8. The assembly of claim 7 wherein the innermost frame has a pair of hinge plates attached to the top edge thereof and is hingedly connected to the interior frame by a pair of adjustable hinge devices;

each of the hinge plates being constructed from a non-corrosive metal and having a pair of hinge ears extending therefrom;

each of the hinge devices being constructed from a non-corrosive metal and being comprised of a tubular hinge having a hollow interior, an exterior, and a threaded hinge post extending at a right angle from the exterior thereof; a hinge pin; a hinge pin screw; a shouldered hinge adjustment nut; a washer spring; a hinge retention plate having a hinge post hole and a plurality of screw holes communicating therethrough; and a plurality of retention plate screws;

the hinge pin having a flanged end and a threaded interior cavity, for threaded engagement with the hinge pin screw, at the end of the pin that is opposite the flanged end;

the interior frame of the assembly having a pair of hinge adjustment holes communicating therethrough that are complimentary to the location of the hinge plates on the innermost frame;

the interior frame further having a pair of recessed areas on the bulkhead surface thereof, each recessed area being configured for insertion of the shouldered hinge adjustment nut, the spring washer, and the hinge retention plate, such that the shouldered hinge adjustment nut can be inserted into the recessed area and protrude through the hinge adjustment hole and rotate while still being retained in the recessed area of the interior frame, the washer spring can be placed in the recessed area adjacent to the shouldered hinge adjustment nut, the retention plate can be placed in the recessed area such that it is level with the bulkhead surface of the interior frame, and the retention plate screws are placed through the retention plate screw holes and threadedly engaged with a threaded hole communicating into the interior frame;

whereby when the shouldered hinge adjustment nut is inserted into the recessed area such that it protrudes through the hinge adjustment hole and rotates while still being retained in the recessed area of the interior frame; the washer spring is placed in the recessed area adjacent to the shouldered hinge adjustment nut; the retention plate is placed in the recessed area such that it is level with the bulkhead surface of the interior frame; the retention plate screws are placed through the retention plate screw holes and threadedly engaged with the interior frame; the hinge post is threadedly engaged with the shouldered hinge adjustment nut; the hinge pin is inserted into one hinge ear, through the hinge, and into the other hinge ear; and the hinge retention screw is threadedly engaged with the hinge pin, the hinge can be adjusted upwardly and downwardly, relative to the interior frame by rotating the shouldered hinge adjustment nut.

9. The assembly of claim 8 wherein the innermost frame has a pair of latch striker plates attached to the bottom edge thereof and the innermost frame can be secured in a closed position by a pair of adjustable window latches;

each of the latch striker plates being constructed from a non-corrosive metal and having a latch stop post protruding therefrom;

each of the latches being constructed from a non-corrosive metal and being comprised of a hollow latch tube having a lip extending into the interior at one end thereof, and also having a latch lever and a latch dog extending from the exterior surface thereof, at the end with the lip, such that the latch lever and latch dog are at a right angle to each other; a latch adjustment post having a hollow end and a threaded end; a latch locking nut; a latch tension spring; a latch tightening screw; a shouldered latch adjustment nut; a washer spring; a latch retention plate having a latch post hole and a plurality of screw holes communicating therethrough; and a plurality of retention plate screws;

the hollow end of the latch adjustment post having a threaded interior cavity, for threaded engagement with the latch tightening screw and the exterior surface of the latch adjustment post being smooth at the hollow such that the smooth surface extends for approximately half the length of the adjustment post and the remainder of the adjustment post is threaded for engagement with the shouldered latch adjustment nut;

the interior frame of the assembly having a pair of latch adjustment holes communicating therethrough that are complimentary to the location of the striker plates on the innermost frame;

the interior frame further having a pair of recessed areas on the bulkhead surface thereof, each recessed area being configured for insertion of the shouldered latch adjustment nut, the spring washer, and the latch retention plate, such that the shouldered latch adjustment nut can be inserted into the recessed area and protrude through the latch adjustment hole and rotate while still being retained in the recessed area of the interior frame, the washer spring can be placed in the recessed area adjacent to the shouldered latch adjustment nut, the latch retention plate can be placed in the recessed area such that it is level with the bulkhead surface of the interior frame, and the retention plate screws are placed through the screw holes and threadedly engaged with a threaded hole communicating into the interior frame;

whereby when the shouldered latch adjustment nut is inserted into the recessed area such that it protrudes through the latch adjustment hole and rotates while still being retained in the recessed area of the interior frame; the washer spring is placed in the recessed area adjacent to the shouldered latch adjustment nut; the latch retention plate is placed in the recessed area such that it is level with the bulkhead surface of the interior frame; the retention plate screws are placed through the screw holes and threadedly engaged with the interior frame; the locking nut is threadedly engaged with the latch adjustment post; the latch post is threadedly engaged with the shouldered latch adjustment nut; the latch tension spring is placed in the hollow latch tube; the hollow latch tube is placed on the latch adjustment post such that the latch dog rests on the latch striker plate against the latch stop post; the latch tightening screw is inserted into the hollow latch tube and threadedly engaged with the latch adjustment post, the latch can be adjusted upwardly and downwardly, relative to the interior frame by rotating the shouldered latch adjustment nut, the latch can be secured relative to the interior frame by rotating the latch locking nut until it is in contact with the shouldered latch adjustment nut, and the latch can be tightened by turning the latch tightening screw thereby securing the innermost frame in a down position; and the latch lever can be rotated one hundred and eighty degrees to release the innermost frame from the secured position so that the innermost frame can be rotated upwardly.

10. The assembly of claim 1 further comprising a screen configured for placement on the exterior frame from the interior of the vessel hull.

11. A port light assembly comprising:

a spigot having a first end, a second end, an inner surface, and an outer surface; the exterior frame further comprising a finish ring having an interior surface and an exterior surface;

the spigot being configured for insertion into a hole in a vessel hull;

the first end of the spigot having a raised sealing portion extending from inner surface thereof;

the finish ring extending at a right angle from the outer surface of the spigot in a flange-like manner at the second end of the spigot and being configured such that when the first end of the spigot is fully inserted into the vessel hull, the finish ring is parallel to and adjacent to the surface of the vessel hull;

the finish ring having plurality of fastener holes communicating therethrough and a flexible gasket connected to the interior surface thereof;

an interior frame having a bulkhead surface and a cabin surface the interior frame being configured for placement around the spigot such that the interior frame rests against a bulkhead on the interior of the vessel hull;

the interior frame also having a plurality of fastener holes communicating therethrough such that the fastener holes on the interior frame are aligned with the fastener holes on the finish ring when the interior frame is placed around the spigot;

an innermost frame having a top edge, a bottom edge, an outside surface, an inside surface, and a pane of glass retained therein;

the innermost frame being connected, at the top edge thereof, to the interior frame by a pair of adjustable hinges such that the innermost frame can be rotated upwardly to an open position or downwardly to a closed position;

the adjustable hinges being threadedly connected to the interior frame;

the pane of glass being secured around its edges by a flexible gasket ring that is affixed to the innermost frame such that when the assembly is installed in a vessel and the innermost frame is in a closed position, the flexible gasket ring contacts the raised sealing portion on the first end of the spigot;

a pair of adjustable latches, that are threadedly connected to the interior frame, for securing the innermost frame in a down position;

a plurality of threaded fasteners;

whereby the spigot is placed through a hole in a vessel hull such that the gasket on the finish ring is in contact with the hull; the interior frame is placed around the spigot such that the fastener holes in the finish ring and the fastener holes in the interior frame are aligned with each other at the interior edge of the hole in the vessel hull; the interior frame and the finish ring are tightly connected by placing threaded connectors in the fastener holes and tightening the connectors; the innermost frame is in a closed position; and the latches are securing the inner frame in a closed position; the assembly creates a watertight seal with the vessel hull without the use of caulks or adhesives on the hull and without the use of additional fastener holes communicating through the vessel hull.

12. The assembly of claim 11 wherein the exterior frame, the interior frame, and the innermost frame are constructed from plastic;

the finish ring, the interior frame, and the innermost frame are reinforced by thin pieces of non-corrosive metal;

the finish ring has a plurality of recessed areas on the exterior surface thereof for placement of the thin pieces of metal;

the thin pieces of metal used to reinforce the finish ring have a plurality of holes communicating therethrough that correspond to the fastener holes communicating through the finish ring and the holes in the metal are adapted for the placement of a carriage head bolt;

the interior frame has a plurality of recessed areas on the cabin surface thereof for placement of the thin pieces of metal;

the thin pieces of metal that reinforce the interior frame have a plurality of holes communicating therethrough that correspond to the fastener holes communicating through the interior frame;

the plurality of threaded fasteners are a plurality of carriage head bolts having a threaded interior cavity, a plurality of flexible O-rings that are sized such that the carriage head bolts can be inserted into the O-rings, and a plurality of truss head fasteners that are threaded for connection to the carriage head bolts;

whereby the exterior frame is threadedly connected to the interior frame, such that the connection is watertight, by placing the spigot through the hole in the vessel hull such that the finish ring covers the edges of the hole but the holes communicating through the spigot ring and the reinforcing metal are not obstructed by the vessel hull, placing the interior frame around the spigot on the inside of the vessel hull such that the holes communicating through the interior frame and reinforcing metal are aligned with the holes communicating through the finish ring, placing a carriage head bolt that has been inserted into a O-ring through each hole in the finish ring and reinforcing metal on the exterior of the hull, placing a truss head fastener through each hole communicating through the interior frame and reinforcing metal on the interior of the hull; and threadedly engaging the truss headed fasteners with the carriage head bolts.

13. The assembly of claim 11 the innermost frame has a pair of hinge plates attached to the top edge thereof and is hingedly connected to the interior frame by a pair of adjustable hinge devices;

each of the hinge plates being constructed from a non-corrosive metal and having a pair of hinge ears extending therefrom;

each of the hinge devices being constructed from a non-corrosive metal and being comprised of a tubular hinge having a hollow interior, an exterior, and a threaded hinge post extending at a right angle from the exterior thereof; a hinge pin; a hinge pin screw; a shouldered hinge adjustment nut; a washer spring; a hinge retention plate having a hinge post hole and a plurality of screw holes communicating therethrough; and a plurality of retention plate screws;

the hinge pin having a flanged end and a threaded interior cavity, for threaded engagement with the hinge pin screw, at the end of the pin that is opposite the flanged end;

the interior frame of the assembly having a pair of hinge adjustment holes communicating therethrough that are complimentary to the location of the hinge plates on the innermost frame;

the interior frame further having a pair of recessed areas on the bulkhead surface thereof, each recessed area being configured for insertion of the shouldered hinge adjustment nut, the spring washer, and the hinge retention plate, such that the shouldered hinge adjustment nut can be inserted into the recessed area and protrude through the hinge adjustment hole and rotate while still being retained in the recessed area of the interior frame, the washer spring can be placed in the recessed area adjacent to the shouldered hinge adjustment nut, the retention plate can be placed in the recessed area such that it is level with the bulkhead surface of the interior frame, and the retention plate screws are placed through the retention plate screw holes and threadedly engaged with a threaded hole communicating into the interior frame;

whereby when the shouldered hinge adjustment nut is inserted into the recessed area such that it protrudes through the hinge adjustment hole and rotates while still being retained in the recessed area of the interior frame; the washer spring is placed in the recessed area adjacent to the shouldered hinge adjustment nut; the retention plate is placed in the recessed area such that it is level with the bulkhead surface of the interior frame; the retention plate screws are placed through the retention plate screw holes and threadedly engaged with the interior frame; the hinge post is threadedly engaged with the shouldered hinge adjustment nut; the hinge pin is inserted into one hinge ear, through the hinge, and into the other hinge ear; and the hinge retention screw is threadedly engaged with the hinge pin, the hinge can be adjusted upwardly and downwardly, relative to the interior frame by rotating the shouldered hinge adjustment nut.

14. The assembly of claim 11 wherein the innermost frame has a pair of latch striker plates attached to the bottom edge thereof and the innermost frame can be secured in a closed position by a pair of adjustable window latches;

each of the latch striker plates being constructed from a non-corrosive metal and having a latch stop post protruding therefrom;

each of the latches being constructed from a non-corrosive metal and being comprised of a hollow latch tube having a lip extending into the interior at one end thereof, and also having a latch lever and a latch dog extending from the exterior surface thereof, at the end with the lip, such that the latch lever and latch dog are at a right angle to each other; a latch adjustment post having a hollow end and a threaded end; a latch locking nut; a latch tension spring; a latch tightening screw; a shouldered latch adjustment nut; a washer spring; a latch retention plate having a latch post hole and a plurality of screw holes communicating therethrough; and a plurality of retention plate screws;

the hollow end of the latch adjustment post having a threaded interior cavity, for threaded engagement with the latch tightening screw and the exterior surface of the latch adjustment post being smooth at the hollow such that the smooth surface extends for approximately half the length of the adjustment post and the remainder of the adjustment post is threaded for engagement with the shouldered latch adjustment nut;

the interior frame of the assembly having a pair of latch adjustment holes communicating therethrough that are complimentary to the location of the striker plates on the innermost frame;

the interior frame further having a pair of recessed areas on the bulkhead surface thereof, each recessed area being configured for insertion of the shouldered latch adjustment nut, the spring washer, and the latch retention plate, such that the shouldered latch adjustment nut can be inserted into the recessed area and protrude through the latch adjustment hole and rotate while still being retained in the recessed area of the interior frame, the washer spring can be placed in the recessed area adjacent to the shouldered latch adjustment nut, the latch retention plate can be placed in the recessed area such that it is level with the bulkhead surface of the interior frame, and the retention plate screws are placed through the screw holes and threadedly engaged with a threaded hole communicating into the interior frame;

whereby when the shouldered latch adjustment nut is inserted into the recessed area such that it protrudes through the latch adjustment hole and rotates while still being retained in the recessed area of the interior frame; the washer spring is placed in the recessed area adjacent to the shouldered latch adjustment nut; the latch retention plate is placed in the recessed area such that it is level with the bulkhead surface of the interior frame; the retention plate screws are placed through the screw holes and threadedly engaged with the interior frame; the locking nut is threadedly engaged with the latch adjustment post; the latch post is threadedly engaged with the shouldered latch adjustment nut; the latch tension spring is placed in the hollow latch tube; the hollow latch tube is placed on the latch adjustment post such that the latch dog rests on the latch striker plate against the latch stop post; the latch tightening screw is inserted into the hollow latch tube and threadedly engaged with the latch adjustment post, the latch can be adjusted upwardly and downwardly, relative to the interior frame by rotating the shouldered latch adjustment nut, the latch can be secured relative to the interior frame by rotating the latch locking nut until it is in contact with the shouldered latch adjustment nut, and the latch can be tightened by turning the latch tightening screw thereby securing the innermost frame in a down position; and the latch lever can be rotated one hundred and eighty degrees to release the innermost frame from the secured position so that the innermost frame can be rotated upwardly.

15. The assembly of claim 11 further comprising a flexible screen frame having a screen secured therein and being configured for placement on the spigot from the interior of the vessel hull.

16. The assembly of claim 11 further comprising a spacing frame configured for placement over the spigot from the interior of a vessel hull;

whereby the frame can be placed over the spigot prior to placing the interior frame over the spigot.

17. A port light assembly comprising:

a spigot having a first end, a second end, an inner surface, and an outer surface; the exterior frame further comprising a finish ring having an interior surface and an exterior surface;

the spigot being configured for insertion into a hole in a vessel hull;

the first end of the spigot having a raised sealing portion extending from inner surface thereof;

the finish ring extending at a right angle from the outer surface of the spigot in a flange-like manner at the second end of the spigot and being configured such that when the first end of the spigot is fully inserted into the vessel hull, the finish ring is parallel to and adjacent to the surface of the vessel hull;

the finish ring having plurality of fastener holes communicating therethrough and a flexible gasket connected to the interior surface thereof;

an interior frame having a bulkhead surface and a cabin surface the interior frame being configured for placement around the spigot such that the interior frame rests against a bulkhead on the interior of the vessel hull;

the interior frame also having a plurality of fastener holes communicating therethrough such that the fastener holes on the interior frame are aligned with the fastener holes on the finish ring when the interior frame is placed around the spigot;

an innermost frame having a top edge, a bottom edge, an outside surface, an inside surface, and a pane of glass retained therein;

the innermost frame being connected, at the top edge thereof, to the interior frame by a pair of adjustable hinges such that the innermost frame can be rotated upwardly to an open position or downwardly to a closed position;

the adjustable hinges being threadedly connected to the interior frame;

the pane of glass being secured around its edges by a flexible gasket ring that is affixed to the innermost frame such that when the assembly is installed in a vessel and the innermost frame is in a closed position, the flexible gasket ring contacts the raised sealing portion on the first end of the spigot;

a pair of adjustable latches, that are threadedly connected to the interior frame, for securing the innermost frame in a down position;

the exterior frame, the interior frame, and the innermost frame being constructed from plastic;

the finish ring, the interior frame, and the innermost frame being reinforced by thin pieces of non-corrosive metal;

the finish ring having a plurality of recessed areas on the exterior surface thereof for placement of the thin pieces of metal;

the thin pieces of metal used to reinforce the finish ring having a plurality of holes communicating therethrough that correspond to the fastener holes communicating through the finish ring and the holes in the metal being adapted for the placement of a carriage head bolt;

the interior frame having a plurality of recessed areas on the cabin surface thereof for placement of the thin pieces of metal;

the thin pieces of metal that reinforce the interior frame having a plurality of holes communicating therethrough that correspond to the fastener holes communicating through the interior frame;

a plurality of carriage head bolts having a threaded interior cavity;

a plurality of flexible O-rings being sized such that the carriage head bolts can be inserted into the O-rings;

a plurality of truss head fasteners that are threaded for connection to the carriage head bolts;

whereby the exterior frame is threadedly connected to the interior frame by placing the spigot through the hole in the vessel hull such that the finish ring covers the edges of the hole but the holes communicating through the spigot ring and the reinforcing metal are not obstructed by the vessel hull and the gasket on the interior surface of the finish ring is in contact with the vessel hull; placing the interior frame around the spigot on the inside of the vessel hull such that the holes communicating through the interior frame and reinforcing metal are aligned with the holes communicating through the finish ring; placing a carriage head bolt that has been inserted into a O-ring through each hole in the finish ring and reinforcing metal on the exterior of the hull, placing a truss head fastener through each hole communicating through the interior frame and reinforcing metal on the interior of the hull; and threadedly engaging the truss headed fasteners with the carriage head bolts, thereby creating a watertight seal between the assembly and the vessel hull without the use of caulks and without the need to place additional fastener holes in the vessel hull.

18. The assembly of claim 17 the innermost frame has a pair of hinge plates attached to the top edge thereof and is hingedly connected to the interior frame by a pair of adjustable hinge devices;

each of the hinge plates being constructed from a non-corrosive metal and having a pair of hinge ears extending therefrom;

each of the hinge devices being constructed from a non-corrosive metal and being comprised of a tubular hinge having a hollow interior, an exterior, and a threaded hinge post extending at a right angle from the exterior thereof; a hinge pin; a hinge pin screw; a shouldered hinge adjustment nut; a washer spring; a hinge retention plate having a hinge post hole and a plurality of screw holes communicating therethrough; and a plurality of retention plate screws;

the hinge pin having a flanged end and a threaded interior cavity, for threaded engagement with the hinge pin screw, at the end of the pin that is opposite the flanged end;

the interior frame of the assembly having a pair of hinge adjustment holes communicating therethrough that are complimentary to the location of the hinge plates on the innermost frame;

the interior frame further having a pair of recessed areas on the bulkhead surface thereof, each recessed area being configured for insertion of the shouldered hinge adjustment nut, the spring washer, and the hinge retention plate, such that the shouldered hinge adjustment nut can be inserted into the recessed area and protrude through the hinge adjustment hole and rotate while still being retained in the recessed area of the interior frame, the washer spring can be placed in the recessed area adjacent to the shouldered hinge adjustment nut, the retention plate can be placed in the recessed area such that it is level with the bulkhead surface of the interior frame, and the retention plate screws are placed through the retention plate screw holes and threadedly engaged with a threaded hole communicating into the interior frame;

whereby when the shouldered hinge adjustment nut is inserted into the recessed area such that it protrudes through the hinge adjustment hole and rotates while still being retained in the recessed area of the interior frame; the washer spring is placed in the recessed area adjacent to the shouldered hinge adjustment nut; the retention plate is placed in the recessed area such that it is level with the bulkhead surface of the interior frame; the retention plate screws are placed through the retention plate screw holes and threadedly engaged with the interior frame; the hinge post is threadedly engaged with the shouldered hinge adjustment nut; the hinge pin is inserted into one hinge ear, through the hinge, and into the other hinge ear; and the hinge retention screw is threadedly engaged with the hinge pin, the hinge can be adjusted upwardly and downwardly, relative to the interior frame by rotating the shouldered hinge adjustment nut.

19. The assembly of claim 17 wherein the innermost frame has a pair of latch striker plates attached to the bottom edge thereof and the innermost frame can be secured in a closed position by a pair of adjustable window latches;

each of the latch striker plates being constructed from a non-corrosive metal and having a latch stop post protruding therefrom;

each of the latches being constructed from a non-corrosive metal and being comprised of a hollow latch tube having a lip extending into the interior at one end thereof, and also having a latch lever and a latch dog extending from the exterior surface thereof, at the end with the lip, such that the latch lever and latch dog are at a right angle to each other; a latch adjustment post having a hollow end and a threaded end; a latch locking nut; a latch tension spring; a latch tightening screw; a shouldered latch adjustment nut; a washer spring; a latch retention plate having a latch post hole and a plurality of screw holes communicating therethrough; and a plurality of retention plate screws;

the hollow end of the latch adjustment post having a threaded interior cavity, for threaded engagement with the latch tightening screw and the exterior surface of the latch adjustment post being smooth at the hollow such that the smooth surface extends for approximately half the length of the adjustment post and the remainder of the adjustment post is threaded for engagement with the shouldered latch adjustment nut;

the interior frame of the assembly having a pair of latch adjustment holes communicating therethrough that are complimentary to the location of the striker plates on the innermost frame;

the interior frame further having a pair of recessed areas on the bulkhead surface thereof, each recessed area being configured for insertion of the shouldered latch adjustment nut, the spring washer, and the latch retention plate, such that the shouldered latch adjustment nut can be inserted into the recessed area and protrude through the latch adjustment hole and rotate while still being retained in the recessed area of the interior frame, the washer spring can be placed in the recessed area adjacent to the shouldered latch adjustment nut, the latch retention plate can be placed in the recessed area such that it is level with the bulkhead surface of the interior frame, and the retention plate screws are placed through the screw holes and threadedly engaged with a threaded hole communicating into the interior frame;

whereby when the shouldered latch adjustment nut is inserted into the recessed area such that it protrudes through the latch adjustment hole and rotates while still being retained in the recessed area of the interior frame; the washer spring is placed in the recessed area adjacent to the shouldered latch adjustment nut; the latch retention plate is placed in the recessed area such that it is level with the bulkhead surface of the interior frame; the retention plate screws are placed through the screw holes and threadedly engaged with the interior frame; the locking nut is threadedly engaged with the latch adjustment post; the latch post is threadedly engaged with the shouldered latch adjustment nut; the latch tension spring is placed in the hollow latch tube; the hollow latch tube is placed on the latch adjustment post such that the latch dog rests on the latch striker plate against the latch stop post; the latch tightening screw is inserted into the hollow latch tube and threadedly engaged with the latch adjustment post, the latch can be adjusted upwardly and downwardly, relative to the interior frame by rotating the shouldered latch adjustment nut, the latch can be secured relative to the interior frame by rotating the latch locking nut until it is in contact with the shouldered latch adjustment nut, and the latch can be tightened by turning the latch tightening screw thereby securing the innermost frame in a down position; and the latch lever can be rotated one hundred eighty degrees to release the innermost frame from the secured position so that the innermost frame can be rotated upwardly.

20. The assembly of claim 17 further comprising a flexible screen frame having a screen secured therein and being configured for placement on the spigot from the interior of the vessel hull.

21. The assembly of claim 17 further comprising a spacing frame configured for placement over the spigot from the interior of a vessel hull;

whereby the frame can be placed over the spigot prior to placing the interior frame over the spigot.

22. An adjustable hinge for a port light having an interior frame and an innermost frame having a pane of glass retained therein, the hinge comprising:

a hinge plate attached to one edge of the innermost frame and hingedly connected to the interior frame by an adjustable hinge device;

the hinge plate being constructed from a non-corrosive metal and having a pair of hinge ears extending therefrom;

the hinge device being constructed from a non-corrosive metal and being comprised of a tubular hinge having a hollow interior, an exterior, and a threaded hinge post extending at a right angle from the exterior thereof; a hinge pin; a hinge pin screw; a shouldered hinge adjustment nut; a washer spring; a hinge retention plate having a hinge post hole and a plurality of screw holes communicating therethrough; and a plurality of retention plate screws;

the hinge pin having a flanged end and a threaded interior cavity, for threaded engagement with the hinge pin screw, at the end of the pin that is opposite the flanged end;

whereby the interior frame has at least one hinge adjustment hole communicating therethrough that is complimentary to the location of the hinge plate on the innermost frame; and at least one recessed area configured for insertion of the shouldered hinge adjustment nut, the spring washer, and the hinge retention plate, such that the shouldered hinge adjustment nut can be inserted into the recessed area and protrude through the hinge adjustment hole and rotate while still being retained in the recessed area of the interior frame, the washer spring can be placed in the recessed area adjacent to the shouldered hinge adjustment nut, the retention plate can be placed in the recessed area such that it is level with the bulkhead surface of the interior frame, and the retention plate screws are placed through the retention plate screw holes and threadedly engaged with a threaded hole communicating into the interior frame; such when the shouldered hinge adjustment nut is inserted into the recessed area so that it protrudes through the hinge adjustment hole and rotates while still being retained in the recessed area of the interior frame; the washer spring is placed in the recessed area adjacent to the shouldered hinge adjustment nut; the retention plate is placed in the recessed area such that it is level with the surface of the interior frame; the retention plate screws are placed through the retention plate screw holes and threadedly engaged with the interior frame; the hinge post is threadedly engaged with the shouldered hinge adjustment nut; the hinge pin is inserted into one hinge ear, through the hinge, and into the other hinge ear; and the hinge retention screw is threadedly engaged with the hinge pin, the hinge can be adjusted upwardly and downwardly, relative to the interior frame by rotating the shouldered hinge adjustment nut.

23. An adjustable latch for a port light having an interior frame and an innermost frame having a pane of glass retained therein that is hingedly connected to the interior frame, the latch comprising:

a latch striker plate attached to the edge of the innermost frame that is opposite an edge of the innermost frame that is hingedly connected to the interior frame;

the latch striker plate being constructed from a non-corrosive metal and having a latch stop post protruding therefrom;

a latch device;

the latch device being constructed from a non-corrosive metal and being comprised of a hollow latch tube having a lip extending into the interior at one end thereof, and also having a latch lever and a latch dog extending from the exterior surface thereof, at the end with the lip, such that the latch lever and latch dog are at a right angle to each other; a latch adjustment post having a hollow end and a threaded end; a latch locking nut; a latch tension spring; a latch tightening screw; a shouldered latch adjustment nut; a washer spring; a latch retention plate having a latch post hole and a plurality of screw holes communicating therethrough; and a plurality of retention plate screws;

the hollow end of the latch adjustment post having a threaded interior cavity, for threaded engagement with the latch tightening screw and the exterior surface of the latch adjustment post being smooth at the hollow such that the smooth surface extends for approximately half the length of the adjustment post and the remainder of the adjustment post is threaded for engagement with the shouldered latch adjustment nut;

whereby the interior frame has at least one latch adjustment hole communicating therethrough that is complimentary to the location of the striker plate on the innermost frame; and at least one recessed area that is configured for insertion of the shouldered latch adjustment nut, the spring washer, and the latch retention plate, such that the shouldered latch adjustment nut can be inserted into the recessed area and protrude through the latch adjustment hole and rotate while still being retained in the recessed area of the interior frame, the washer spring can be placed in the recessed area adjacent to the shouldered latch adjustment nut, the latch retention plate can be placed in the recessed area such that it is level with the surface of the interior frame, and the retention plate screws are placed through the screw holes and threadedly engaged with a threaded hole communicating into the interior frame; such that when the shouldered latch adjustment nut is inserted into the recessed area so that it protrudes through the latch adjustment hole and rotates while still being retained in the recessed area of the interior frame; the washer spring is placed in the recessed area adjacent to the shouldered latch adjustment nut; the latch retention plate is placed in the recessed area such that it is level with the surface of the interior frame; the retention plate screws are placed through the screw holes and threadedly engaged with the interior frame; the locking nut is threadedly engaged with the latch adjustment post; the latch post is threadedly engaged with the shouldered latch adjustment nut; the latch tension spring is placed in the hollow latch tube; the hollow latch tube is placed on the latch adjustment post such that the latch dog rests on the latch striker plate against the latch stop post; the latch tightening screw is inserted into the hollow latch tube and threadedly engaged with the latch adjustment post, the latch can be adjusted upwardly and downwardly, relative to the interior frame by rotating the shouldered latch adjustment nut, the latch can be secured relative to the interior frame by rotating the latch locking nut until it is in contact with the shouldered latch adjustment nut, and the latch can be tightened by turning the latch tightening screw thereby securing the innermost frame in a down position; and the latch lever can be rotated one hundred and eighty degrees to release the innermost frame from the secured position.

* * * * *